United States Patent [19]

Marteau D'Autry

[11] 4,020,698

[45] May 3, 1977

[54] PIPETTE WHICH MAY BE CALIBRATED

[76] Inventor: Eric Marteau D'Autry, 69-72 rue Gambetta, Villiers-le-Bel 95 Arnouville-les-Gonesse, France

[22] Filed: Oct. 28, 1975

[21] Appl. No.: 625,893

[30] Foreign Application Priority Data

Oct. 29, 1974 France ..... 74.36136

[52] U.S. Cl. ..... 73/425.6

[51] Int. Cl.[2] ..... B01L 3/02

[58] Field of Search ..... 73/425.6, 425.4 P

[56] References Cited

UNITED STATES PATENTS

| | | | |
|---|---|---|---|
| 3,013,435 | 12/1961 | Rodrigues, Jr. | 73/425.6 |
| 3,232,117 | 2/1966 | Gilmont | 73/425.6 |
| 3,343,539 | 9/1967 | Moorhouse | 73/425.6 X |
| 3,506,164 | 4/1970 | Weichselbaum et al. | 73/425.6 UX |
| 3,613,952 | 10/1971 | Gilmont et al. | 73/425.6 UX |
| 3,760,639 | 9/1973 | Sokol et al. | 73/425.6 |
| 3,810,391 | 5/1974 | Suovaniemi | 73/425.6 |
| 3,815,790 | 6/1974 | Allen et al. | 73/425.6 X |
| 3,855,867 | 12/1974 | Roach | 73/425.6 |
| 3,855,868 | 12/1974 | Suovaniemi | 73/425.6 |

*Primary Examiner*—Richard C. Queisser

*Assistant Examiner*—Joseph W. Roskos

[57] ABSTRACT

A pipette in which the volume of liquid measured is a function of the stroke of a piston and can be calibrated to vary the volume measured, by varying the stroke. The pipette has a casing formed with a vertically elongate, open ended cavity, part of which cavity threadably engages a threaded portion on an open ended tube disposed in the cavity. A piston actuating rod passes through the tube. A push-button is mounted on the upper end of the rod and projects from the upper end of the tube which is countersunk into the casing. Below the lower end of the tube, a bush is integrally mounted on the rod and urged upwardly by spring pressure towards the lower end of the tube. The stroke of the piston is the distance between the lower end of the tube and the upper face of the bush when the push-button is not being depressed. This distance is variable to calibrate the pipette by rotatably screwing the tube in or out relatively to the casing, using a special key engageable with the upper end of the tube. A friction ring captive between the sleeve and the wall of the cavity prevents inadvertent rotation of the tube with respect to the casing.

11 Claims, 2 Drawing Figures

PIPETTE WHICH MAY BE CALIBRATED

Figure 1:
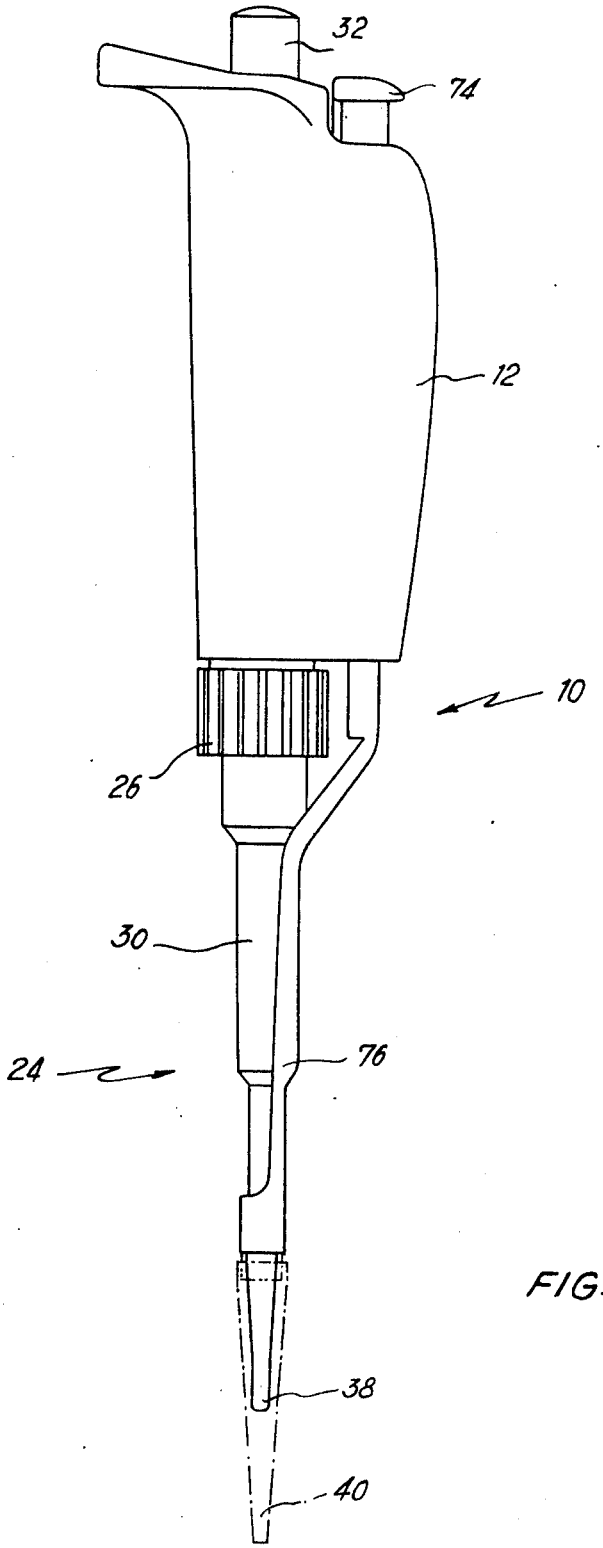

The present invention relates to a pipette which may be calibrated, intended to withdraw a given quantity of liquid.

A certain number of precision pipettes are already known, which are intended to withdraw predetermined quantities of liquid and whose operating principle is based on the displacement of a piston-rod arrangement inside the body of the pipette. Such pipettes generally comprise:

a casing of oblong shape defining internally an essentially cylindrical cavity intended to receive, in its centre, the rod of a piston-rod arrangement urged permanently upwards in a resilient manner, said rod being capped at its upper end by a push-button member able to be actuated from outside said casing and an outer tube fixed adjacent said casing and coaxially with respect to said cavity, inside which the lower part of the piston-rod arrangement of straight circular section is able to slide, by actuation of the push-button member, in a sealed manner and along a certain predetermined path, limited in both directions, so as to define a variable volume chamber intended to cause filling or discharge of the sample to be taken. Such a pipette is described in French Pat. No. 73.32978 for example.

Variations of this type of pipette are known which are not adjustable and which are intended to always withdraw the same quantity of liquid, and which are thus not able to be calibrated or re-adjusted. Now it is known that if it is desired to obtain very accurate experimental results, it is frequently necessary to re-calibrate the pipette in order to be able to take into account a certain number of corrections such as a temperature correction for example. Fixed pipettes, i.e. pipettes which are calibrated once and for all when they are assembled, thus have the drawback of not being able to be subsequently re-calibrated.

Adjustable pipettes are also known of the type described in French Pat. No. 73.32978. In practice, the adjustment of such pipettes has not proved to be sufficiently fine. In addition, an adjustment system of this type always comprises a lock nut accessible from outside the pipette. Consequently, owing to a false movement, this arrangement has the drawback of risking causing unlocking of this lock nut. It is clear that if such an incident occurs during use, the entire experiment has to be re-started.

Furthermore, in practice, it has proved very desirable to be able to have a pipette whose adjustment or calibration system is integrated in the casing of the pipette, so as to be able to be actuated solely by certain reliable people capable of carrying out re-calibration of the pipette carefully, for example by means of an appropriate key or like tool. Due to such a calibration system, there is no danger of a false movement during use by the operator who, without an appropriate adjustment key, could not modify the adjustment of the pipette.

The present invention therefore relates to an adjustable pipette making it possible to eliminate all the above-mentioned drawbacks.

Inside the cavity provided in the casing, the pipette according to the invention comprises a calibration member arranged coaxially with respect to said cavity and whereof at least the upper part is in the shape of a sleeve to which a movement of rotation about its axis may be imparted. On at least one part of its outer surface, the calibration member comprises a screw thread intended to co-operate with a corresponding screw thread provided on the inner surface of said cavity. The pipette according to the invention also comprises a tubular abutment part coaxial with respect to said calibration member and adjacent the lower end of the latter, said abutment member being intended to co-operate with the upper bearing surface of a locking bush, integral with the rod of the piston-rod arrangement, in order to limit the useful upwards travel of said piston-rod arrangement in an adjustable manner, said calibration member also comprising, on its outer surface, an annular groove able to receive a braking ring compressed between the inner surface of the cavity of the casing and the outer surface of said calibration member in order to prevent the latter from rotating.

According to another essential feature of the present invention, at its upper end, the calibration sleeve terminates in an adjusting ring located inside the cavity in the pipette casing so that it is not directly accessible from outside said casing.

The present invention will be described hereafter in more detail with reference to the accompanying drawings illustrating a particular embodiment of the invention given as a non-limiting example.

Figure 2:
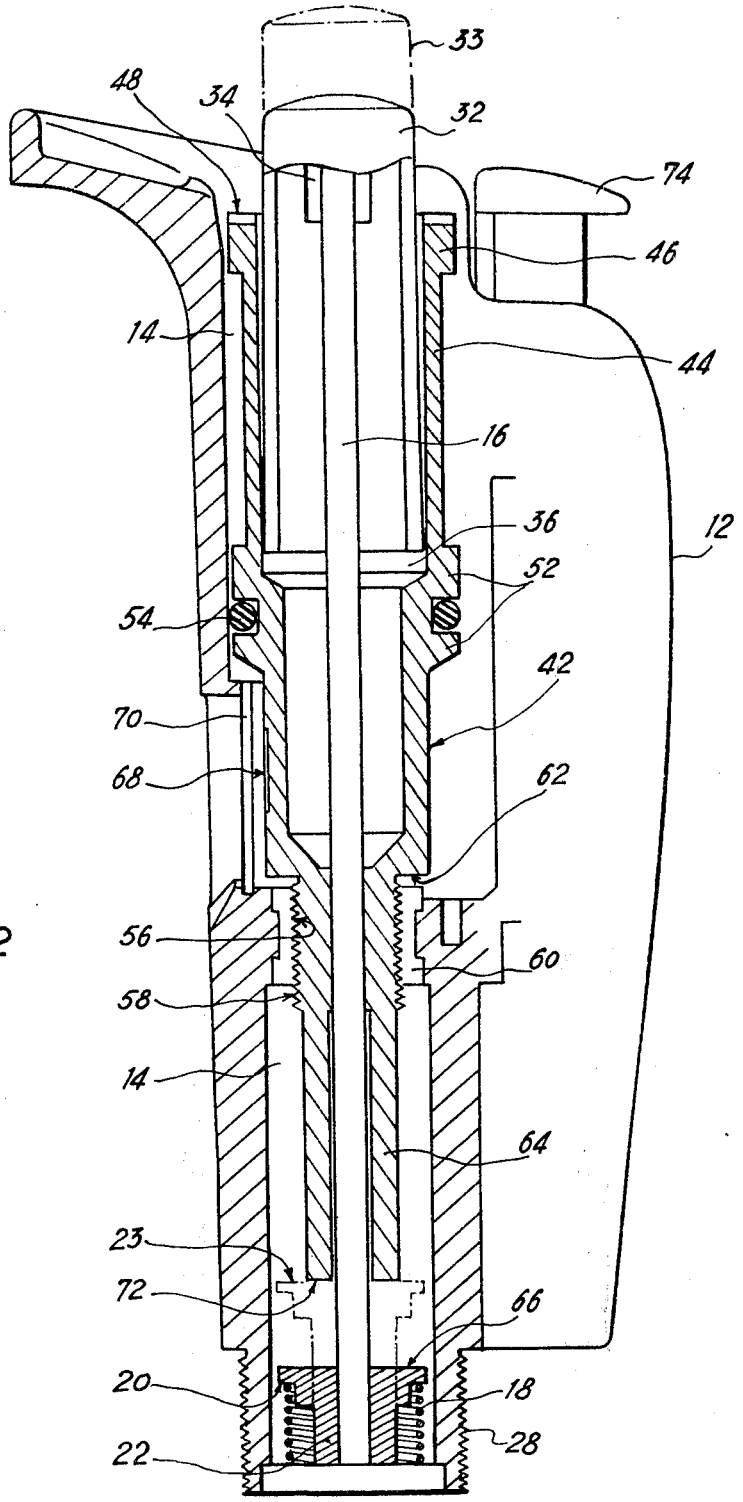

In the accompanying drawings,

FIG. 1 shows diagrammatically a side view of a pipette according to the invention which may be calibrated and FIG. 2 shows a side view in partial section of the casing of the pipette incorporating the calibration device according to the invention.

In the accompanying FIGS. 1 and 2, identical parts have been given the same reference numerals.

The pipette arrangement 10 illustrated in FIG. 1 comprises a casing 12 of oblong shape defining internally an essentially cylindrical cavity 14. The center of this cavity 14 is intended to receive the rod 16 of a piston-rod arrangement urged permanently upwards in a resilient manner by means of a coil spring 18. The upper end of the coil spring 18 bears against an annular abutment surface 20 provided on a locking bush 22 integral with the rod 16 of the piston-rod arrangement. The lower end of said spring 18 bears against a centering washer (not shown) which bears against the upper end of the outer tube 24. The outer tube 24 is fixed adjacent the lower end of the casing 12 and coaxially with respect to the cavity 14 by means of a nut 26 screwed onto the outer screwthread 28 of the lower end of the casing 12 of the pipette. In its tubular part 30, the outer tube 24 comprises a cylindrical cavity of straight circular section corresponding substantially to the outer diameter of the lower part of the piston-rod arrangement. The upper end of the rod 16 is capped by a push-button member 32, which may be actuated from outside the pipette. In the embodiment described, the push-button 32 is in the shape of a cylindrical cap fixed permanently on the rod 16 by means of a small inner sleeve 34 and by its lower surface 36. Actuation of the push-button member 32 causes sealed sliding of the lower part of the piston-rod arrangement in the tubular part 30 of the outer tube 24 of the pipette. This predetermined travel is limited in both directions in order to define a variable volume chamber, able to cause either filling or discharge of the sample to be taken. It will be noted in FIG. 1 that the lower tubular end 38 of the outer tube of the pipette is provided with a removable tip 40 made from non-wetting material. Such tips 40 always have an inner volume sufficiently great to contain the entire sample taken, which thus makes it possible to eliminate any risk of contamination of the lower end 38 by the liquid withdrawn in the removable tip 40.

The inner cavity 14 provided in the casing 12 of the pipette 10 is intended to receive a calibration member 42 arranged coaxially to said cavity 14. The upper part of the calibration member is in the shape of a sleeve 44 to which may be imparted a movement of rotation about its axis. The upper end of said sleeve 44 terminates in a ring 46 whose upper surface has a particular relief, for example a plurality of grooves 48 intended to co-operate with a corresponding adjusting key or any other appropriate similar member. In the embodiment described in FIG. 2, the sleeve 44 terminates in a ring 46 inside the cavity 14 of the casing 24. The ring 46 is thus not directly accessible from outside the casing.

The outer surface of the calibration member 42 comprises a double annular shoulder 52 defining a groove intended to receive a braking ring 54. Said braking ring 54 is compressed between the outer surface of the calibration member 42 and the inner surface of the cavity 14 in the pipette casing. Friction mounting of the braking ring 54 makes it possible to prevent the sleeve 42 from rotating in any chosen position. The braking ring 54 should be made from a flexible material, which is elastically deformable but resistant to wear and tearing. The braking ring 54 may be made from a fluorocarbon resin, polychloroprene or preferably an elastomeric polyurethane for example. In practice, straight-chain polyurethanes have proved to be particularly satisfactory.

On part of its outer surface, the calibration member 42 comprises a screwthread 56 intended to co-operate with a corresponding screwthread 58 provided on the innersurface of the cavity 14. Said screwthread 58 is located in a narrow region of said cavity. In the embodiment described in FIG. 2, this narrow part is obtained by the presence of a ring 60 integral with the casing 12 of the pipette 10. By rotation of the member 42 about its axis, the two screwthreads 56 and 58 make it possible to cause an upwards or downwards movement of the calibration arrangement 42. Above its screwthread 56, said member 42 comprises a support surface 62, perpendicular to the axis of the pipette, which is intended to fulfil the function of an abutment in order to limit the downwards movement of the calibration member 42. The lower end of the screwthread 56 may also have an outer projection intended to limit the upwards movement of the calibration member 42. In the particular embodiment described, no member of this type is present, however the screwthread 56 is extended sufficiently downwards to prevent any risk of involuntary dismantling of the member 42 subsequent to inopportune operation of the sleeve 44. In fact, to unscrew the member 42 completely, it would be necessary to rotate this member about its axis at least a dozen times.

The pipette according to the invention also comprises a tubular abutment member 64 coaxial to the calibration member 42 and adjacent the lower end of the latter. Said tubular abutment member 64 is intended to co-operate with the upper support surface 66 of the locking bush 22, in order to limit the useful upwards travel of the piston-rod arrangement in an adjustable manner.

The outer surface of the calibration member 42 comprises a graduation 68 on its entire circumference. This graduation 68 associated with reference numbers, visible through a transparent reading window 70 located opposite said graduation, is representative of the position of said sleeve inside the cavity provided in the pipette casing.

According to a particular embodiment, the tubular abutment member 64 and the calibration member 42 are made in one and the same piece. It is quite clear that according to one variation of the present invention, the member 64 could be made in the form of a spacer member independent of the calibration member 42, disposed between said member and the locking bush 22.

The piston-rod arrangement illustrated in full line in FIG. 2 corresponds to its lowest possible position, the coil spring 18 being compressed. The upper position of the piston-rod arrangement has been shown by the illustration in dot-dash lines of the upper part 33 of the push-button member and the locking bush 23.

Calibration or adjustment of the pipette takes place in the following manner. By means of an appropriate key comprising projections engaging in the grooves 48 in the upper ring of the sleeve 44, it is possible to screw or unscrew the entire calibration member 42, which causes a variation in height of the lower abutment surface 72 of the tubular member 64. In practice, a single complete rotation of the calibration member 42 will be sufficient to proceed with all the calibration operations. One rotation corresponds to a movement of the calibration member 42 by approximately one millimeter upwards or downwards.

It is advisable to note the prime importance of the annular braking ring 54, which is intended to prevent the calibration member 42 from rotating in the chosen position corresponding to a well defined limitation of the travel of the piston-rod arrangement in the upwards direction.

Furthermore, the casing 12 of the pipette 10 also comprises a device for ejecting the removable tip 40, as described in French Pat. No. 74.34588. Solely the push-button 74 and ejection member proper 76 of this device are illustrated.

Naturally, the present invention is not limited to the embodiment described, but it is quite possible, without diverging from the framework of the invention, to imagine other variations of the parts constituting the calibration system for the pipette. Thus, the braking ring 54, for which it was recommended to use a straight-chain polyurethane, may be made from any other suitable material which is elastically deformable and has good resistance to wear and tearing.

What is claimed is:

1. Pipette having a fixed volume which can be calibrated, of the type comprising:

a casing of oblong shape defining internally and essentially cylindrical cavity intended to receive, at its center, the rod of a piston-rod arrangement urged permanently upwards in a resilient manner, said rod being capped at its upper end by a push-button member able to be actuated from outside said casing and an outer tube, fixed to said casing coaxially with respect to said cavity, inside which the lower part of the piston-rod arrangement of straight circular section is able, due to actuation of the push-button member, to slide in a sealed manner and along a certain predetermined path limited in both directions, in order to define a variable volume chamber intended to cause filling or discharge of the sample to be taken, characterised by the fact that it comprises, inside said cavity in the casing, a calibration member arranged coaxially to the latter and whereof at least the upper part is in the shape of a sleeve, to which is imparted a rotary movement about its axis; by the fact that the calibration member comprises, on at least part of its outer surface, a screwthread intended to co-operate with a corresponding screwthread provided on the inner surface of said cavity; by the fact that said pipette also comprises a tubular abutment member coaxial with respect to the calibration member and adjacent the lower end of the latter, said abutment member being intended to co-operate with a locking bush integral with said rod of the piston-rod arrangement, in order to limit the useful upwards travel of said piston-rod arrangement in an adjustable manner and by the fact that the outer surface of the calibration member comprises an annular groove able to receive a braking ring compressed between the inner surface of the cavity in the casing and the outer surface of said calibration member in order to prevent the latter from rotating.

2. Pipette according to claim 1, characterised by the fact that said sleeve terminates at its upper end in a ring intended to allow the adjustment by rotation of the calibration member.

3. Pipette according to claim 2, characterised by the fact that the ring is located inside the cavity in the casing so that it is not directly accessible from outside the casing of the pipette.

4. Pipette according to, claim 2 characterised by the fact that the ring has an appropriate relief, such as an arrangement of grooves, intended to co-operate with a corresponding adjustment member, such as an adjustment key.

5. Pipette according to, claim 1 characterised by the fact that the outer surface of the calibration member comprises a graduation representative of the position of said sleeve inside the cavity provided in the pipette casing.

6. Pipette according to claim 5, characterised by the fact that the casing of the pipette comprises a reading window located opposite said graduation.

7. Pipette according to, claim 1 characterised by the fact that the screwthread provided on the inner surface of the cavity provided in the casing in the pipette is located in a narrow region of said cavity.

8. Pipette according to, claim 1 characterised by the fact that the outer surface of the calibration member comprises two annular shoulders determining the groove able to receive said braking ring.

9. Pipette according to, claim 1 characterised by the fact that the push-button member is in the shape of a cylindrical cap of oblong shape covering the rod of the piston-rod arrangement and being permanently fixed on the latter, said cap having an outer diameter substantially equal to the inner diameter of the sleeve of the calibration member.

10. Pipette according to, claim 1 characterised by the fact that the calibration member and the tubular abutment member are made in one and the same piece.

11. Pipette according to, claim 1 characterised by the fact that the braking ring is made from a flexible material, which is elastically deformable and resistant to wear and tearing, such as a fluorocarbon resin, polychloroprene or preferably polyurethanes for example.

* * * * *